US005370173A

United States Patent [19]

Schneider et al.

[11] Patent Number: 5,370,173

[45] Date of Patent: Dec. 6, 1994

[54] PROCESS AND APPARATUS FOR VERTICAL CONTINUOUS CASTING OF METAL

[75] Inventors: Wolfgang Schneider, St. Augustin; Hans P. Krug, Rheinbach-Flerzheim, both of Germany

[73] Assignee: VAW Aluminium AG, Bonn, Germany

[21] Appl. No.: 30,653

[22] Filed: Mar. 12, 1993

[30] Foreign Application Priority Data

Mar. 12, 1992 [DE] Germany ..... 4207895

[51] Int. Cl.[5] ..... B22D 11/10

[52] U.S. Cl. ..... 164/487; 164/444; 164/439; 164/420

[58] Field of Search ..... 164/487, 444, 489, 439

[56] References Cited

U.S. PATENT DOCUMENTS 4,069,862 1/1978 Carson ..... 164/444

FOREIGN PATENT DOCUMENTS 230563 12/1963 Austria .
0150670 12/1984 European Pat. Off. ..... B22D 11/16
3041842 7/1982 Germany ..... B22D 11/10
364080 8/1962 Switzerland .
944561 12/1963 United Kingdom .

*Primary Examiner*—Kuang Y. Lin
*Attorney, Agent, or Firm*—Perman & Green

[57] ABSTRACT

Process and apparatus for vertical continuous casting of metal in at lest one hot-top mold with metal supplied at constant level. The object of the invention is to provide a process and an apparatus that make it possible, while supplying metal at constant level, to avoid non-uniform temperature gradients, turbulence, and waste of metal. According to the invention this is achieved by coordinating the level, flow rate and distribution of molten metal to each hot-top mold from the outlet opening of a smelting furnace. This is produced by a pouring spout or trough that is supported through the upper wall area of each hot-top mold to supply molten metal to each hot-top mold through central outlet openings in the side walls of the trough, with the bottom of the trough being in a plane below the level of the outlet opening of the smelting furnace and below the upper surface of the melt in the hot-top mold, and with the trough outlet openings supplying molten metal to the center of each mold and causing it to flow outwardly therefrom.

7 Claims, 2 Drawing Sheets

PROCESS AND APPARATUS FOR VERTICAL CONTINUOUS CASTING OF METAL

BACKGROUND OF THE INVENTION

The invention relates to a process and an apparatus for the vertical continuous casting of metal in one or more hot-top ingot molds with metal supplied at constant, uniform level to each said mold.

DISCUSSION OF THE PRIOR ART

Supplying metal at constant level to hot-top ingot molds is known. In the "Aluminium-Taschenbuch" [Aluminum Handbook] (14th edition, 1984, p. 23), a so-called hot-top casting method is described in which feeding of the molten metal, such as aluminum, is not done in tile usual manner, through a nozzle-float system which, after the level of the melt in the mold sinks, allows more molten metal to flow through the metal casting which has hardened and moved vertically downward. In the described method, a constant level of the molten metal is maintained by the arrangement of the molds and the molten metal supply lines on a single plane. According to the principle of communicating tubes, the level of the melt can be kept constant all the way back to the smelting furnace. Because of the vertical downward movement of the hardened metal in the hot-top mold, the liquid metal is supplied through simple lateral feed from openings in the side wall of the metal supply trough, spillway or spout located next to the molds and through openings in a side wall of the molds, to the continuous casting. In this manner, four or more molds can be supplied simultaneously with molten metal. The process described in the aforementioned publication, and the corresponding apparatus, have a variety of disadvantages. The unilateral asymmetric supply of molten metal can result in turbulence or splattering, especially at start-up. In addition, the creation of temperature gradients between the feed spout discharge openings and the opposite wall of the mold cannot be avoided, so that the hardening behavior of the metal is uneven and non-uniform. Another disadvantage is the volume of the residue of metal that remains in the feed spout or trough and does not flow through the side wall, which volume can not be supplied to the mold, especially toward the end of the pouring process.

Therefore there is a need for a method and an apparatus which make it possible to avoid asymmetric temperature gradients, turbulence, and wasted volumes of metal while supplying molten metal, such as aluminum, to a vertical continuous casting at the same level as at the smelting furnace outlet.

SUMMARY OF THE INVENTION

According to the present invention, equality of the levels of a molten metal in each hot-top ingot mold and at the outlet opening of a smelting furnace is produced by means of a trough, spillway or pouring spout that is guided through the upper part of the hot-top ingot mold and which provides a communication with the molten metal in the hot-top ingot mold through discharge openings in the side walls of the trough, with the bottom or floor of the trough being on a plane below the level of the metal at the outlet opening of the smelting furnace and below the upper level of the molten in the hot-top mold.

The trough, spillway or pouring spout may be associated with a plurality of hot-top molds located on the same plane. The flow of molten metal from the trough is promoted by the vertical downward movement of the hardened molded continuous metal body being formed in each hot-top mold.

The apparatus; according to the invention is characterized by the fact that the trough, spillway or pouring spout, which conveys a continuous stream of metal into the open top of each hot-top ingot mold is supported into and out of each intermediate mold through opposed openings in an insulating collar that forms a surrounding wall around the upper part of each hot-top ingot mold, so that the bottom of the trough or pouring spout is just below the surface level of the melt confined within the mold by the insulating collar of the hot-top mold, and by the fact that within the walled area formed by the insulating collar, the side walls of the trough or pouring spout have opposed outlet openings to allow the molten metal stream to spill out into a central area of the melt and to flow towards the opposed walls of the mold for uniform circulation.

On the basis: of the direct symmetric guidance and support of the trough, spillway or pouring spout, and the central opposed outlet openings for the passage of the stream of metal, a maximally laminar flow pattern is produced in the mold. This arrangement makes it possible to distribute or circulate the stream of metal from the middle of the surface of the molten metal in each ingot mold uniformly to the outer periphery or circumference of each mold. The solidifying surface of the metal body being formed are subjected to uniform supply, and a fine grained and especially uniform metal structure is produced. This results in a defect-free surface area of the molded metal body, so that the previously-required step of milling prior to further processing can be limited to a much smaller surface area of the cast metal body. No undesirable non-uniform temperature gradients occur, so that symmetric hardening occurs. At the end of the pouring process, the entire metal melt flows practically quantitatively into the molds.

The trough, spillway or pouring spout can be connected with a plurality of hot-top molds. It communicates with the smelting furnace to convey the molten metal, such as aluminum, to each of the molds.

Since the pouring spout or trough, with its outlet openings, is surrounded on all sides by molten aluminum metal, within the insulating collar inside the mold, it should preferably be made of one-piece ceramic material. When there are several molds supplied by the same trough, the ceramic components should be aligned and interconnected through the intermediate molds. To cut off the metal stream at the terminal mold, a ceramic sealing element is provided at the end of the trough. The latter consists of a sealing wall, preferably made of ceramic material, and of the same height as the surrounding side walls of the trough. If an extension of the trough should become necessary later on, the sealing element can be removed as desired and fastened to the new end of the extended trough.

An embodiment of the invention is described in detail with reference to the accompanying drawing.

DETAILED DESCRIPTION

Figure 1:
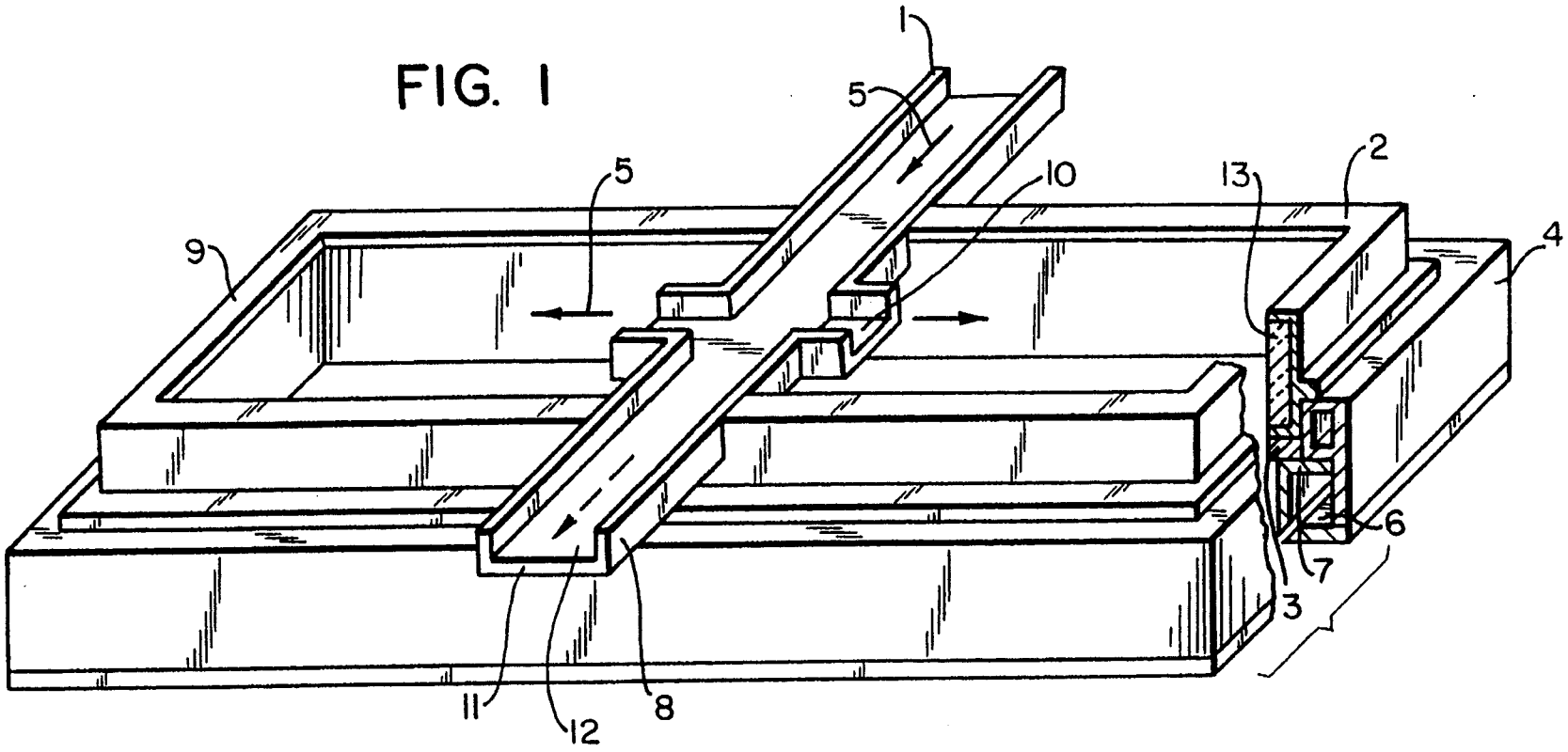
FIG. 1 is a perspective view of a hot-top ingot mold with means for supplying molten metal thereto at a constant level equal to the level of the molten metal at the outlet opening of a smelting furnace and FIG. 2 is a prospective view of the hot-top ingot mold according to FIG. 1 filled with molten metal.
Figure 2:
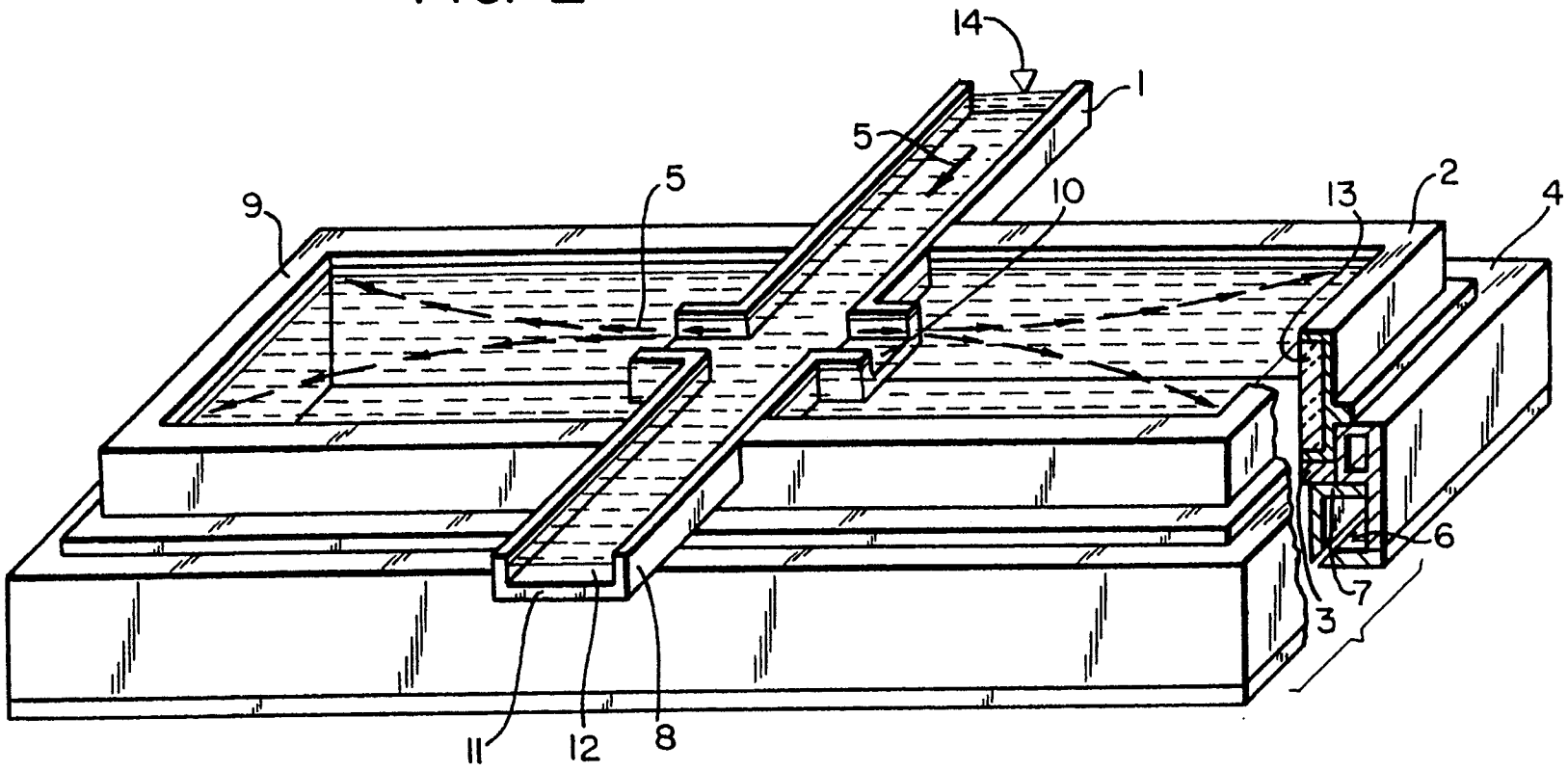

The hot-top ingot mold shown in FIG. 1 has a rectangular cross section and consists of the mold frame 4 provided with cooling channels 6 and an upper insulating collar 2 forming a surrounding wall. A hot-top strip 3 is mounted on a support surface 7 surrounding mold frame 4, on which strip the insulating collar 2 rests. Insulating collar 2 consists of a loading chamber 13 provided with an insulating covering. Insulating collar 2 surrounds and confines the ingot mold at the top, and the opposed long walls thereof are intersected at central areas by a pouring spout or trough. The side walls 8 of the trough are flush with the upper sealing edge 9 of the insulating collar 2. The trough or pouring spout 1 has opposed discharge openings 10 located symmetrically at central areas of its two side walls 8, said openings serving to permit the melt to flow into the center of the mold. The stream of metal 5, which comes from a smelting furnace (not shown here), is guided through the discharge openings 10 into the middle of each ingot mold. Extension 11 of trough 1 leads to the next ingot mold. During the continuous casting process, the level of the metal in trough 1 and in loading chamber 13 of the mold is the same. The gravity flow of metal stream 5 is produced by the vertical downward movement of the hardened ingots being formed in each ingot mold. In FIG. 2, the hot-top ingot mold is shown filled with molten metal. It is evident that only one metal level exits in the entire casting system. The level of the metal in pouring spout, spillway or trough 1 and insulating collar 2 extends to just below the upper edge of trough 1 and/or collar 2. To regulate the level of the metal, a simple level sensor 14 can be used in all molds. This controls in known fashion the tilting movement of the smelting furnace and the flow rate when pouring the molten metal into spout or trough 1. FIG. 2 also shows the flow pattern achieved according to the invention. The main flow 5 through the transverse openings 10 is directed towards the far-distant narrow sides of the rectangular mold and produces a uniform circulation over the solidifying surface of the metal block being produced. A flow that is as uniform as possible over the solidifying surface, especially in the areas that are very important for the quality of the casting, in the outer edges of the molded metal body being created, is of critical importance to the optimization of the vertical continuous casting process. So-called cold spots can also be reliably avoided in the corner areas of the mold, so that the surface quality of the finished metal block is much smoother and more uniform than in previous methods with interrupted metal supply.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Process for the continuous vertical casting of metal in at least one hot-top ingot mold, comprising the steps of feeding molten casting metal from a smelting furnace to the top of one or more hot-top ingot molds which are on the same plane, through an elongate trough which opens into the upper area of each said hot-top ingot mold to supply molten metal thereto as the continuous casting being formed in each mold is vertically lowered, to maintain said metal at a predetermined casting level, characterized by said trough communicating between the outlet opening of a smelting furnace and the upper area of each said hot top ingot mold, through the side wall of a surrounding rectangular wall at the upper area of each said mold, said rectangular wall comprising opposed surrounding side walls which are longer than the opposed surrounding end walls thereof, said trough having side walls which confine the molten metal, a floor area which is below the level of the molten metal supply in the smelting furnace and below the predetermined casting level of the molten metal in the mold, and opposed outlet openings in the side walls of the trough at surface area of the molten metal in the hot-top ingot mold, to cause the molten metal to gravity-flow from the furnace into the central surface area of the molten metal in the hot-top mold and to circulate in opposed directions towards the inner periphery of said surrounding end walls and over the solidifying surface of the continuous casting being formed and lowered in said mold, thereby maintaining a continuous gravity flow of molten metal, and a more uniform distribution thereof, between the furnace and each said mold.

2. Process according to claim 1, characterized in providing communication between the trough and a plurality of hot-top molds located on the same plane, by supporting a continuous trough for extension through the opposed surrounding walls of each said hot-top mold, said trough having a pair of said outlet openings located at the central surface area of the molten metal in each said hot-top mold.

3. Process according to claim 1 characterized by maintaining a continuous flow of metal to each mold by correlating the vertical downward movement of the hardened molded metal body in each said hot-top mold and the flow rate of molten metal to the upper area of said mold.

4. Process according to claim 1 characterized by sensing the level of molten metal in said trough, and regulating the flow rate of molten metal from the smelting furnace to maintain said level uniform.

5. Apparatus for the continuous vertical casting of metal in a hot-top ingot mold, comprising means for feeding metal from a smelting furnace to the top areas of one or more hot-top ingot molds which are on the same plane, said top areas being enclosed by a peripheral rectangular surrounding wall having opposed surrounding side walls which are longer than the opposed surrounding end walls thereof, said means comprising an elongate trough which extends through said surrounding side wall of each hot-top mold to supply molten metal thereto and maintain a predetermined casting level as the continuous casting being formed in each said mold is vertically lowered, said trough communicating between the outlet opening of a smelting furnace having a predetermined supply level and the upper area of at least one said hot-top mold through said surrounding side wall thereof, said trough having side walls which confine the molten metal therein, a floor area which is below the predetermined supply level of the molten metal in the smelting furnace and below the predetermined casting level of the molten metal in each said mold, and opposed outlet openings at areas of the side walls of the trough which cause molten metal present therein to flow therefrom into a central surface area of the molten metal in each said hot-top mold in opposed directions towards the inner periphery of said surrounding end walls, whereby a continuous gravity flow of molten metal, and a more uniform distribution thereof, is maintained between the furnace and each said mold.

6. Apparatus according to claim 5 comprising a plurality of hot-top molds and a continuous trough which communicates between the smelting furnace, intermediate hot-top ingot molds and a terminal hot-top ingot mold, said trough being supported for extension through opposed areas of the surrounding wall of each said intermediate hot-top ingot mold, and through the surrounding wall of the terminal hot-top ingot mold, to permit a gravity flow of molten metal from the smelting furnace to the central area of the molten metal in each said hot-top ingot mold.

7. Apparatus according to claim 5 further comprising means for sensing the level of molten metal in said trough, and means for regulating the supply of molten metal from the smelting furnace to the trough to maintain said level uniform.

* * * * *